US010920541B2

(12) United States Patent
Robey et al.

(10) Patent No.: US 10,920,541 B2
(45) Date of Patent: Feb. 16, 2021

(54) PERFORATING DEVICE

(71) Applicant: Halliburton Energy Services, Inc., Houston, TX (US)

(72) Inventors: Richard Ellis Robey, Mansfield, TX (US); Christopher C. Hoelscher, Arlington, TX (US); James Wight, Mansfield, TX (US); Joseph Todd MacGillivray, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/774,483

(22) PCT Filed: Jan. 6, 2017

(86) PCT No.: PCT/US2017/012449
§ 371 (c)(1),
(2) Date: May 8, 2018

(87) PCT Pub. No.: WO2018/128619
PCT Pub. Date: Jul. 12, 2018

(65) Prior Publication Data

US 2020/0284125 A1 Sep. 10, 2020

(51) Int. Cl.
*E21B 43/112* (2006.01)
*E21B 43/117* (2006.01)

(52) U.S. Cl.
CPC ..... *E21B 43/112* (2013.01); *E21B 43/117* (2013.01)

(58) Field of Classification Search
CPC .... E21B 43/112; E21B 43/116; E21B 43/117; E21B 43/26
See application file for complete search history.

(56) References Cited

U.S. PATENT DOCUMENTS

| | | | | |
|---|---|---|---|---|
| 4,844,167 | A * | 7/1989 | Clark | E21B 23/14 175/4.53 |
| 6,378,625 | B1 | 4/2002 | Chen | |
| 7,225,872 | B2 | 6/2007 | Zupanick | |
| 2003/0070811 | A1 | 4/2003 | Robison et al. | |
| 2006/0060355 | A1 | 3/2006 | Bell et al. | |
| 2006/0131020 | A1 | 6/2006 | Zupanick | |

FOREIGN PATENT DOCUMENTS

| | | | |
|---|---|---|---|
| EP | 2706190 | A2 | 3/2014 |

* cited by examiner

*Primary Examiner* — Kristyn A Hall
(74) *Attorney, Agent, or Firm* — John W. Wustenberg; Parker Justiss, P.C.

(57) ABSTRACT

The present disclosure provides an perforating device for use within a wellbore. The perforating device comprises a center member having a length, an expansion tool positioned about the center member along at least a portion of the length, and a plurality of perforating guns positioned about the expansion tool, each of the plurality of perforating guns configured to carry one or more explosive shaped charges. The expansion tool is configured to move the plurality of perforating guns radially outward toward a wellbore target of a wellbore it is configured to be positioned within.

8 Claims, 8 Drawing Sheets

PERFORATING DEVICE

CROSS-REFERENCE TO RELATED APPLICATION

This application is the National Stage of, and therefore claims the benefit of, International Application No. PCT/US2017/012449 filed on Jan. 6, 2017, entitled "PERFORATING DEVICE". The above application is commonly assigned with this National Stage application and is incorporated herein by reference in its entirety.

TECHNICAL FIELD

This application is directed, in general, to completing an oil well and, more specifically, to a perforating device for perforating a wellbore.

BACKGROUND

An oil or gas well may be drilled from the surface through a variety of producing and non-producing subterranean formations. The wellbore may be drilled vertically and in some applications, have some horizontal displacement. Conventional well construction includes a heavy steel casing. Wellbore casings include casing strings which are generally fixed within the wellbore by a cement layer between the outer wall of the casing and the wall of the wellbore. Once the casing string is positioned at a desired location, a cement slurry is pumped via the interior of the casing, around the lower end of the casing and upward into the annulus. The casing may also include one or more liner strings which typically extend from near the bottom of a previous casing down into an uncased portion of the well. Liner strings are typically lowered downhole and include a liner hanger at its uphole end, whereafter the liner hanger is expanded outward into sealing or gripping engagement with the casing string. During completion of a cased well, the casing is perforated in order to connect the inside of the wellbore casing with the oil or gas reservoir into which the well has been drilled. Casing perforation is also performed during closing of a well—the casing is perforated and then washed and cemented for abandonment. During completion of a non-cased or 'natural completion, the formation is perforated as an open hole without any casing or cement in the reservoir at the zone of interest.

Traditional perforating devices have a fixed diameter and are hollow carriers with perforating guns that shoot radially outward at the casing or formation. However, during perforating, fluid between the carrier and perforating target negatively impacts the performance of the explosive shaped charges employed. What is needed is a perforating device configured to place perforating guns as close as possible to the perforating target (the inner surface of the casing, or exposed formation) to prevent fluid from decreasing the effectiveness of the perforating charges.

BRIEF DESCRIPTION

Reference is now made to the following descriptions taken in conjunction with the accompanying drawings, in which.

DETAILED DESCRIPTION

During drilling and installation of an oil and gas well, after a wellbore casing is installed and casing string is secured in cement, the casing may be perforated to connect the inner casing surface with the outer casing surface, connecting the casing with the oil and gas reservoir into which it has been drilled. Additionally, during closing of a well, the casing wall is perforated and the perforated areas are washed and then plugged using cement.

Traditional perforating devices include hollow carriers with a fixed diameter, with charges positioned inside the hollow carrier such that the shaped charge creates a hydrodynamic jet of metal that penetrates the casing wall creating fluid communication between the wellbore and reservoir. During abandonment, there is typically fluid within the casing and in some cases, a large fluid clearance may exist from the outer diameter of the hollow carrier to the inner surface of the casing. The effectiveness of the shaped charge, which has to travel through the fluid before reaching the inner surface of the casing or exposed formation, may be negatively impacted.

Accordingly, the present disclosure provides for a perforating device comprising perforating guns positioned about a central device, the device configured to move the perforating guns radially outward toward the target, which may be the casing, such that the perforating guns detonate a shaped charge at an optimum distance from the casing wall. By reducing the distance between the perforating guns and the target, the shaped charges need only overcome a minimal (for example, zero in certain instances) amount of fluid clearance, thereby providing a more controlled charge performance than previously available from conventional perforating gun carriers.

Figure 1:
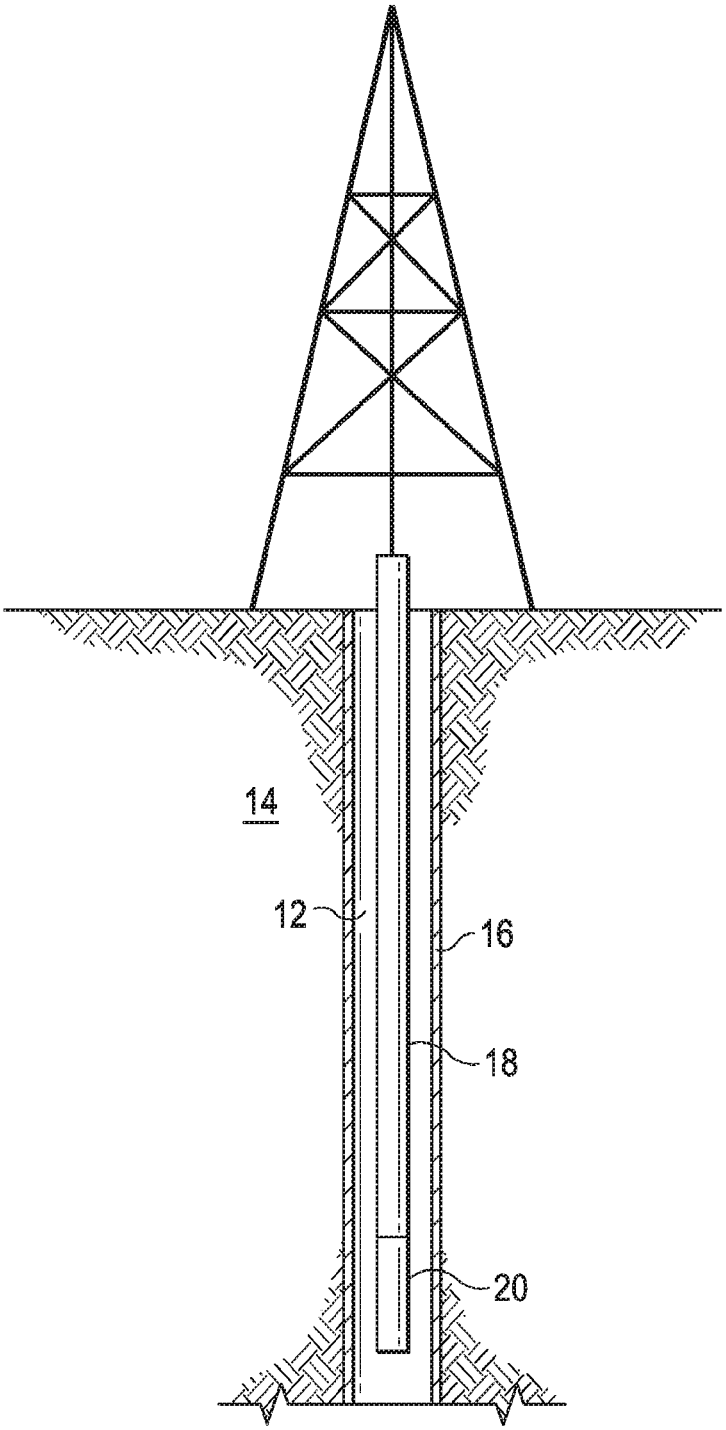
FIG. 1 is an environmental sectional view of a service rig having a perforating device according to the present disclosure attached thereto.

Reference will now be made to the drawings wherein like reference numerals identify similar structural features or aspects of the subject disclosure. For purposes of explanation and illustration, and not limitation, FIG. 1 illustrates a service rig 10 positioned over and around wellbore 12, drilled into subterranean formation 14 for recovering energy sources which may be found therein. A service rig 10 could be a floating vessel, a combination of surface support equipment, a drilling rig, a wireline unit, or a workover rig. Wellbore 12 includes an internal target surface 16 which could be casing, a liner or even the exposed formation face where a cased well may have a casing string set cemented therein. A perforating device 20 is shown inserted into the wellbore 12, shown suspended by a work string 18. The work string 18 may comprise any type of work string or production string, including, but not limited to a string of jointed pipes, slickline, electric wire-line, coiled tubing, and other types of conveyances known in the drilling, completing or logging arts for conveying tools such as perforating device 20 down into a wellbore. Although wellbore 12 is shown as a vertical formation, wellbore 12 may comprise various shapes and/or geometries according to drilling needs and geographic configurations.

Perforating device 20 is conveyed downhole into the wellbore 12 with a plurality of perforating guns mounted thereon at a first, undeployed position having a smaller diameter. Once the perforating device reaches a desired location within the wellbore, the perforating guns are moved radially outward toward the inner surface of wellbore 12 to a second deployed position having a larger diameter, relative to the first undeployed position. In this expanded position, the explosive shaped charges therein are discharged in order to perforate the internal target surface 16.

It is also contemplated that the equipment as described herein can be used in conjunction with equipment and sensors associated with a measurement-while-drilling (MWD) apparatus, which may be incorporated into the work string 18 for insertion in the wellbore 12 as part of a MWD system. In a MWD system, MWD and other sensors associated with the MWD apparatus provide data to the MWD apparatus for communicating up the work string 18 to an operator of the drilling system. These sensors typically provide directional information of the work string 18 so that the operator can monitor the orientation of the work string 18 in response to data received from the MWD apparatus and adjust the orientation of the work string 18 in response to such data. An MWD system also typically enables the communication of data from the operator of the system down the wellbore 12 to the MWD apparatus. Systems and methods as disclosed herein can also be used in conjunction with logging-while-drilling (LWD) systems and equipment related therewith, which log data from sensors similar to those used in MWD systems as described herein.

Figure 2A:
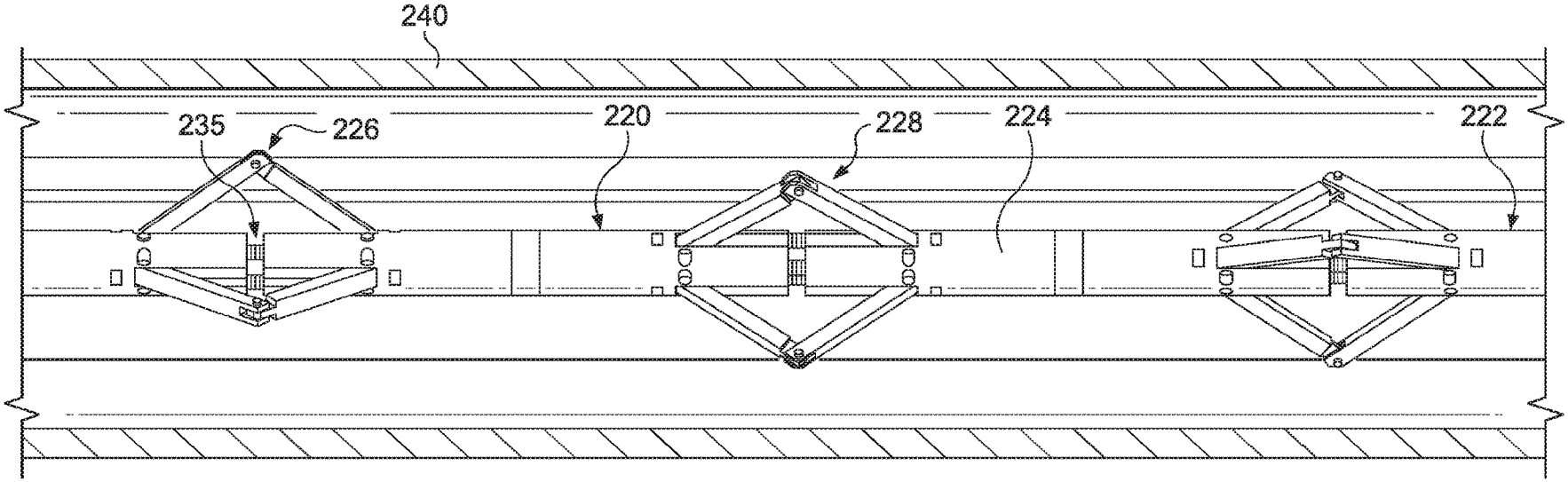
FIG. 2A is a side view of one embodiment of a perforating device according to aspects of the present disclosure.
Figure 2B:
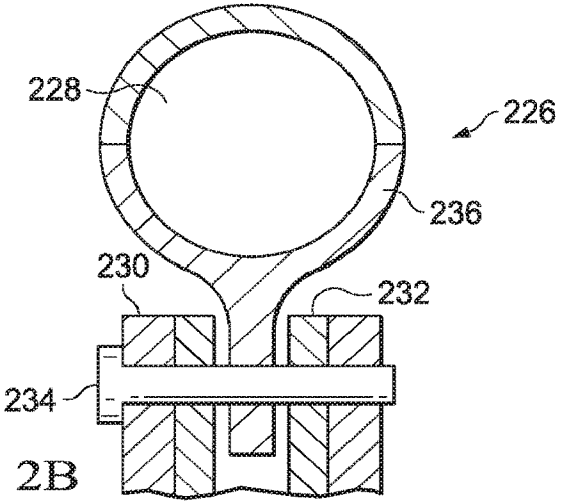
FIG. 2B is a view illustrating one of a plurality of fingers of the perforating device shown in FIG. 2A.

Referring now to FIGS. 2A and 2B, there is shown one embodiment of a perforating device 220 according to the present disclosure. Perforating device 220 shown in a deployed position, has a central member 222 having a length. Perforating device 220 may be coupled with and conveyed into the wellbore by a work string or other type of conveyance suspended from a service rig above. Coupled about central member 222 and spanning at least a part of the length thereof is a finger carrier 224 having a plurality of fingers 226 with perforating guns 228 mounted thereon. Each perforating gun 228 is configured to carry explosive shaped charges therein.

FIG. 2B provides a more detailed view showing how the perforating guns 228 are secured with each of the plurality of fingers 226. Each of the plurality of fingers 226 comprises a first bar 230 and a second bar 232, the first bar 230 and second bar 232 coupled together at a pivot point via a pivot pin 234. Coupled proximal with and extending radially outward from pivot pin 234 is perforating gun 228. In some embodiments, perforating gun 228 may be coupled beneath pivot pin 234 via a clamp 236 or similar suitable link known in the art. The perforating device 220 is inserted into the wellbore with the plurality of fingers 226 in a first, non-deployed position, wherein the first bar 230 and second bar 232 are about linear with finger carrier 224. When the perforating device 220 reaches a desired location within the wellbore, the plurality of fingers 226 may be moved radially outward. Upon relative motion of the core rod 235, the finger carriers 224 are axially displaced towards one another. This creates a radial travel of the pivot pin 234, increasing the effective outer diameter of the embodiment. The core rod 235 may be axially displaced relative to the finger carriers 224 using any number of forces or mechanisms, including but not limited to hydraulic, mechanical, a propellant based setting tool, or even the embodiment's own weight. Any of these could be easily accommodated by one skilled in the art of well perforating, logging or completions. By compressing the plurality of fingers 226, the first bar 230 and second bar 232 move radially outward toward the wellbore target 240, moving at least one perforating gun 228 radially outward and proximal with the wellbore target 240 into a second deployed position. Once proximal with the wellbore target 240, the perforating guns 228 are at an optimal fluid clearance, determined according to the well application, for detonating the shaped explosive charges such that fluid pressures and densities therein and various other factors known in the art have minimal impact on the performance of the charges. The plurality of perforating guns 228 may be configured to carry various types of shaped explosive charges. Once the perforating guns 228 are proximate to the wellbore target 240, either the exposed formation or casing, the explosive charges may be detonated to perforate the wellbore target 240. The wellbore target 240 could be a wellbore casing, a wellbore liner, or a bare formation. Once the explosive charges are detonated, the first and second bars 230 and 232 may be returned to the first, non-deployed position by the same types of forces or mechanisms used for deployment; such as hydraulic or mechanical. An example embodiment could be relaxing of an applied load, allowing a spring or another stored energy source to displace the core rod 235 axially to its first position, thereby increasing the distance between the finger carriers. For one skilled in the art, accommodating a means to axially displace the finger carriers 224 to their first position is easily accomplished.

Referring now to FIG. 3A-3D, there is shown another embodiment of a perforating device 320 according to the present disclosure. Perforating device 320 comprises a central member 322 having a length and a plurality of fingers 326 positioned thereabout, each of the plurality of fingers 326 having a perforating gun 328 mounted on at least one end thereof. The plurality of fingers 326 are mounted to the central member 322, such that the mandrel 336 is housed within the central member 322. The mandrel 336 may be hydraulically or mechanically activated in much the same manner as the previous embodiment discussed in relation to FIGS. 2A and 2B, such that axial travel of the mandrel 336 results in some radial displacement of the finger 326.

Figure 3A:
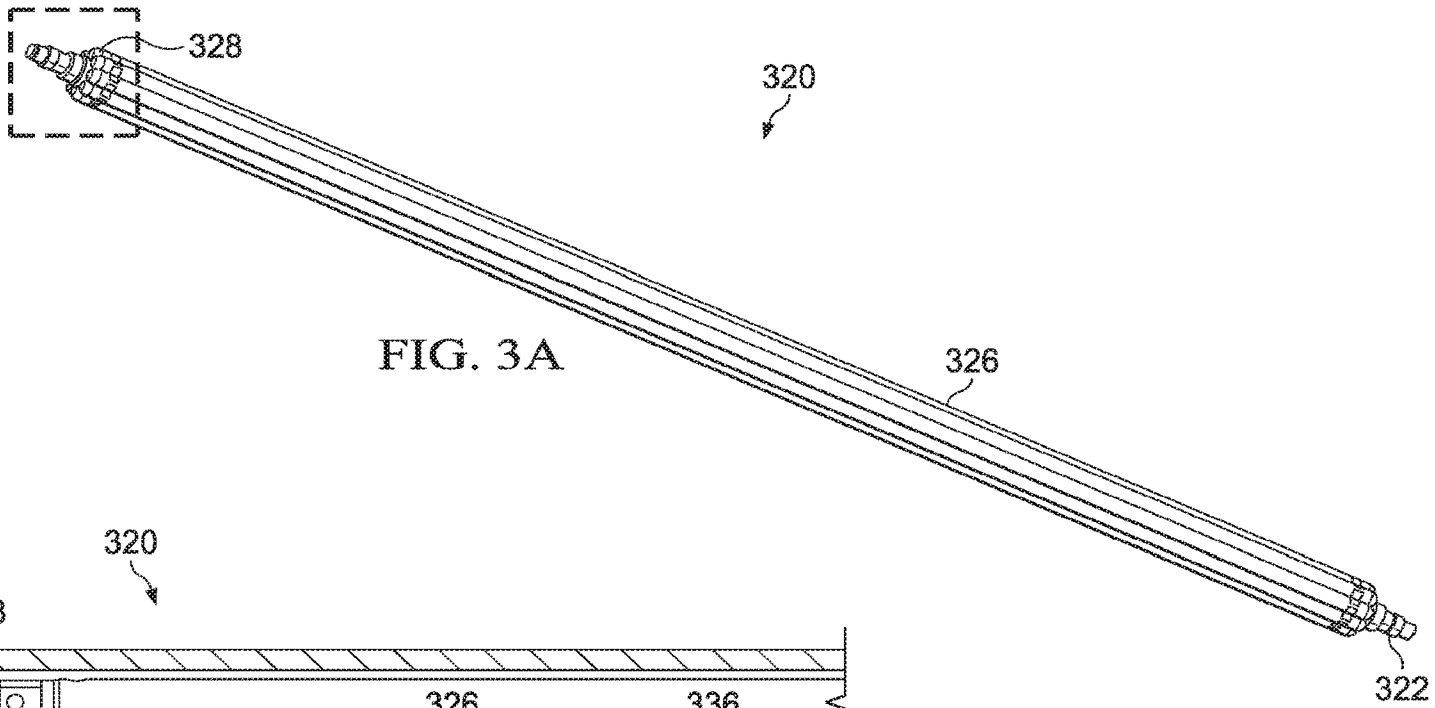
FIG. 3A is a perspective view of another embodiment of a perforating device according to the present disclosure shown in a first position.
Figure 3B:
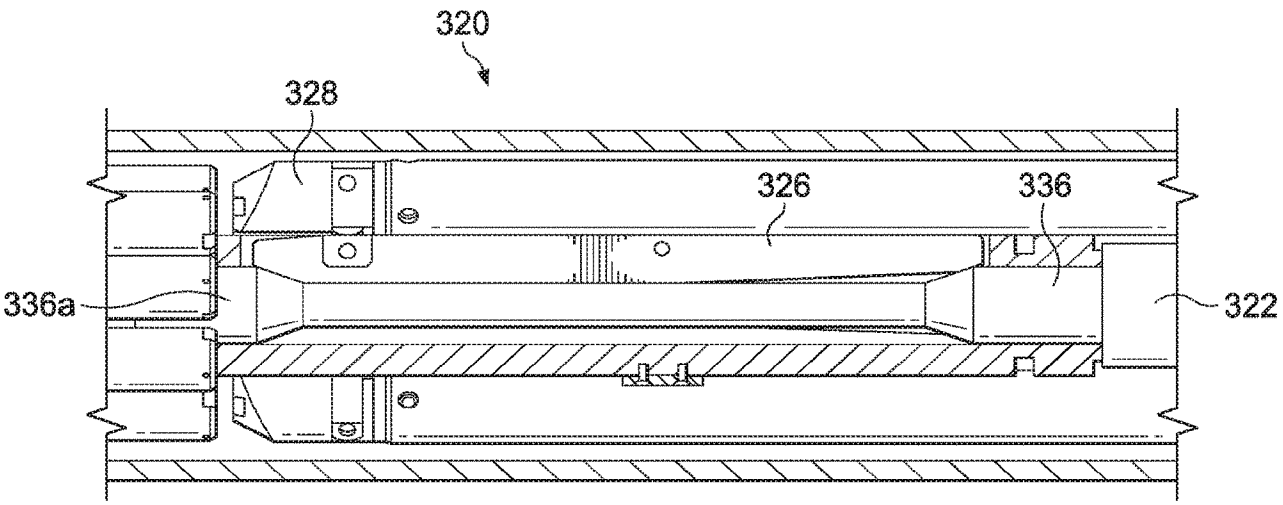
FIG. 3B is an alternate view of the perforating device of FIG. 3A in a first position.
Figure 3C:
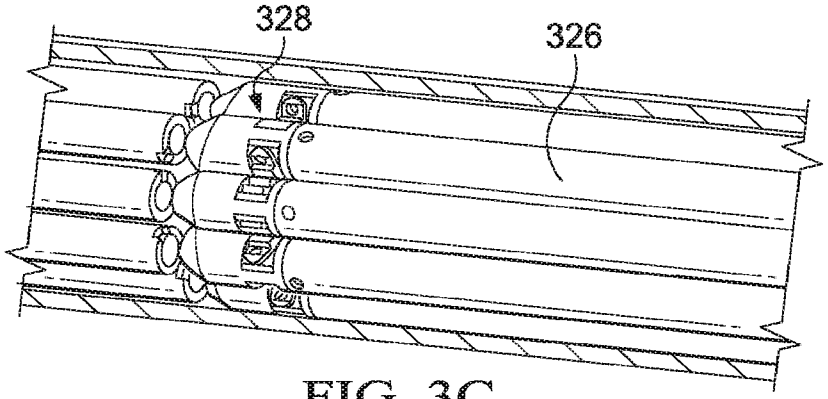
FIG. 3C is a perspective view of the perforating device of FIG. 3A shown in a second position.
Figure 3D:
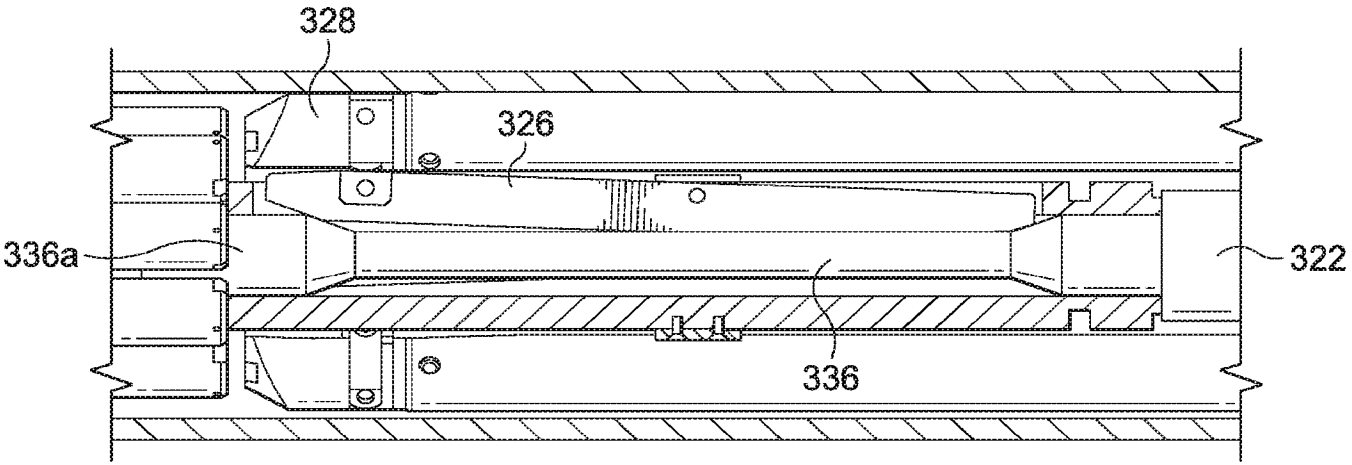
FIG. 3D is an alternate view of the perforating device of FIG. 3C in a second position.

When perforating device 320 is conveyed into the wellbore, the plurality of fingers 326 are configured in a first position as shown in FIG. 3A, at a smaller diameter. In this state, the plurality of fingers 326 are positioned proximal with the central member 322. In the first position, the mandrel 336 is about linear with the plurality of fingers 326 with a revolved profile about its length 336*a*. Once at a desired location within the wellbore, the mandrel 336 may be displaced axially relative to the central member 322 as shown in FIG. 3D such that the plurality of fingers 326 move radially outward from the central member 322 as shown in FIG. 3C. In this state, the perforating guns 328 are proximal with the wellbore target for optimum fluid clearance such that there is minimal fluid impact on the charge performance of the explosive charges of perforating guns 328.

Once the perforating guns 328 are proximate to the wellbore target, the explosive charges may be detonated to perforate the wellbore target. Once the explosive charges have been detonated, the plurality of fingers 326 and perforating guns 328 may be returned to the first, non-deployed position by the same types of forces used for deployment; such as hydraulic or mechanical. An example embodiment could be relaxing of the applied hydraulic load used to displace the mandrel 336, allowing a spring or another stored energy source to return the mandrel 336 axially to its first position, thereby acting on the plurality of fingers to move them back to their original radial position. For one skilled in the art, accommodating a means to axially displace the mandrel to its first position is easily accomplished.

Figure 4:
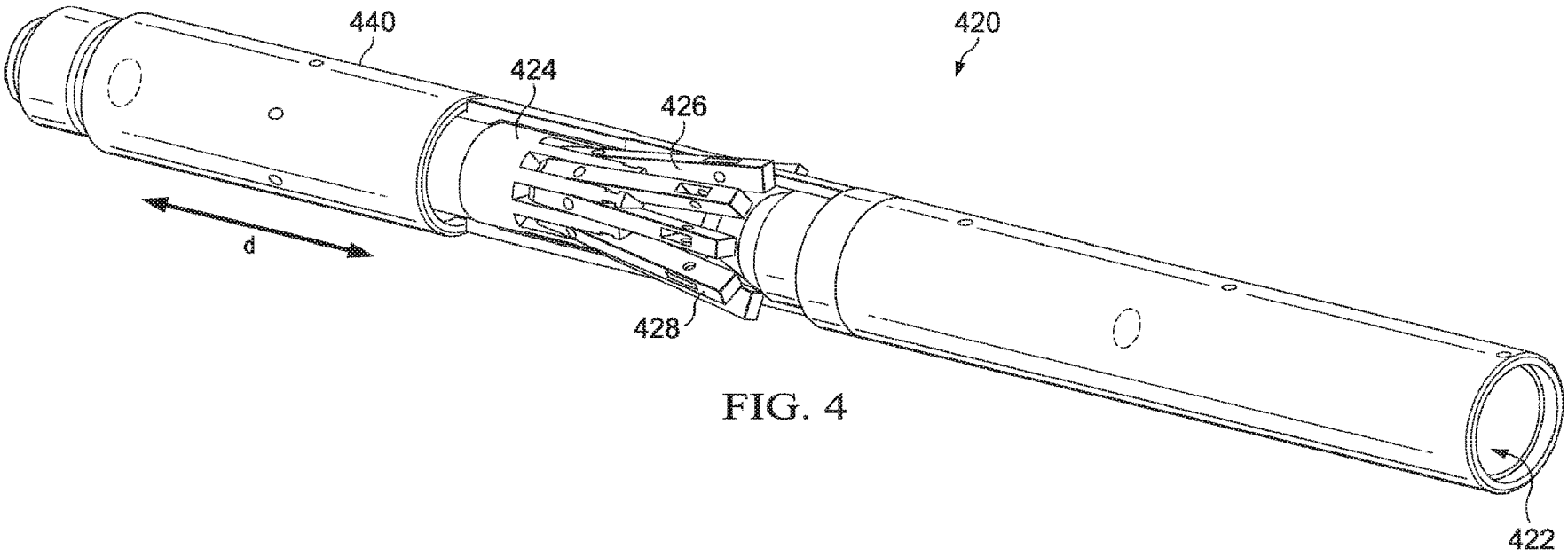
FIG. 4 is a perspective view of another embodiment of a perforating device according to the present disclosure.

Referring now to FIG. 4, there is shown another embodiment of a perforating device 420 according to the present disclosure. Perforating device 420 includes a central member 422 having a profiled mandrel 424 having a plurality of fingers 426, each having a proximal and distal end. Positioned at the distal end of each finger 426 is at least one perforating gun 428, each perforating gun 428 configured to carry an explosive shaped charge. A sliding mandrel 440 is coupled around center member 422, configured to slide linearly along the center member 422 and over the profiled mandrel 424.

As the perforating device 420 is inserted downhole into the well, the sliding mandrel 440 is positioned over the plurality of fingers 426, such that the plurality of fingers 426 are linearly aligned along center member 422. When the perforating device 420 reaches a desired location within the wellbore, tubing pressure activates an axial piston of the center member 422 to move the sliding mandrel 440 linearly along center member 422. As the sliding mandrel 440 moves linearly, the plurality of fingers 426 are deployed radially outward from the central member 422 such that the perforating guns 428 on the distal ends thereof move radially outward toward the wellbore target. Once the perforating guns 428 are proximate to the wellbore target, the explosive charges may be detonated to perforate the wellbore target.

Once the explosive charges are detonated, the sliding mandrel 440 may be linearly moved back over the plurality of fingers 426 by wellbore pressure acting on one side of the axial piston and tubing pressure on an opposing side. By lowering or releasing tubing pressure on the opposing side of the piston while annulus pressure remains, differential pressure may be used to slide the sliding mandrel 440 back into a first undeployed position, pulling the plurality of fingers 426 radially inward into the first undeployed position.

Figure 5A:
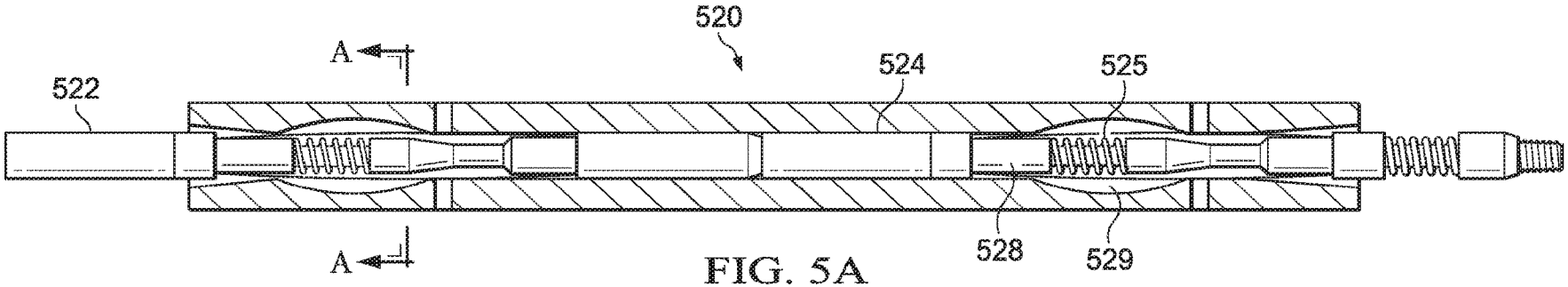
FIG. 5A is a perspective view of yet another embodiment of a perforating device according to the present disclosure.
Figure 5B:
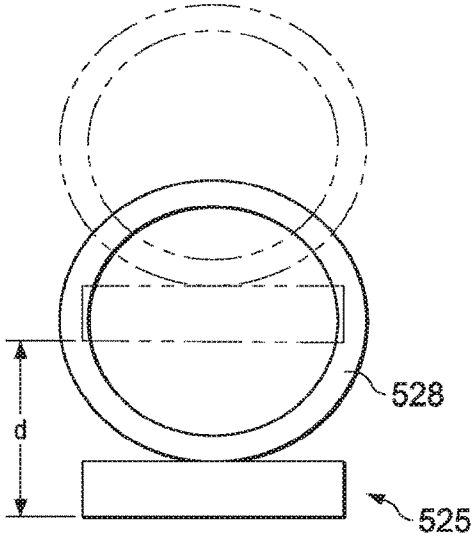
FIG. 5B is an alternate view of a spring and perforating gun of the perforating device shown in FIG. 5A.

Referring now to FIG. 5A-5B, there is shown another embodiment of a perforating device 520 according to the present disclosure. Perforating device 520 includes a central member 522 having a series of springs 525 mounted circumferentially thereabout. The plurality of springs 525 may comprise leaf springs, bow springs, and other springs used in downhole tools and equipment. Fastened atop each of the springs 525 is at least one perforating gun 528. The perforating gun 528 may be fastened with each spring 525 via a clamp, a bolt, bonded, and other suitable mechanical connection. Referring to FIG. 5B, there is a section view along cross-section A. FIG. 5B illustrates deflection distance d that each perforating gun 528 may move when the springs 525 are radially deflected by a mandrel 529 with at least one profile of revolution displaced axially relative to the central member 522. The profiled mandrel 529 may be moved by any of the hydraulic or mechanical forces discussed in conjunction with the previous embodiments shown in FIG. 2A through FIG. 4. Movement of the mandrel causes the springs 525 to bend from a first, undeployed position to deflect into a second, deployed position, thereby deflecting the perforating guns 528 outward toward the wellbore target. Once the perforating guns 528 are proximate to the wellbore target, the explosive charges may be detonated thereby perforating the wellbore target.

Once the explosive charges are detonated, the mandrel 529 may be axially displaced to its first position thereby returning the springs 525 to the first undeployed position, thus returning the perforating gun 528 to its first undeployed position.

Figure 6:
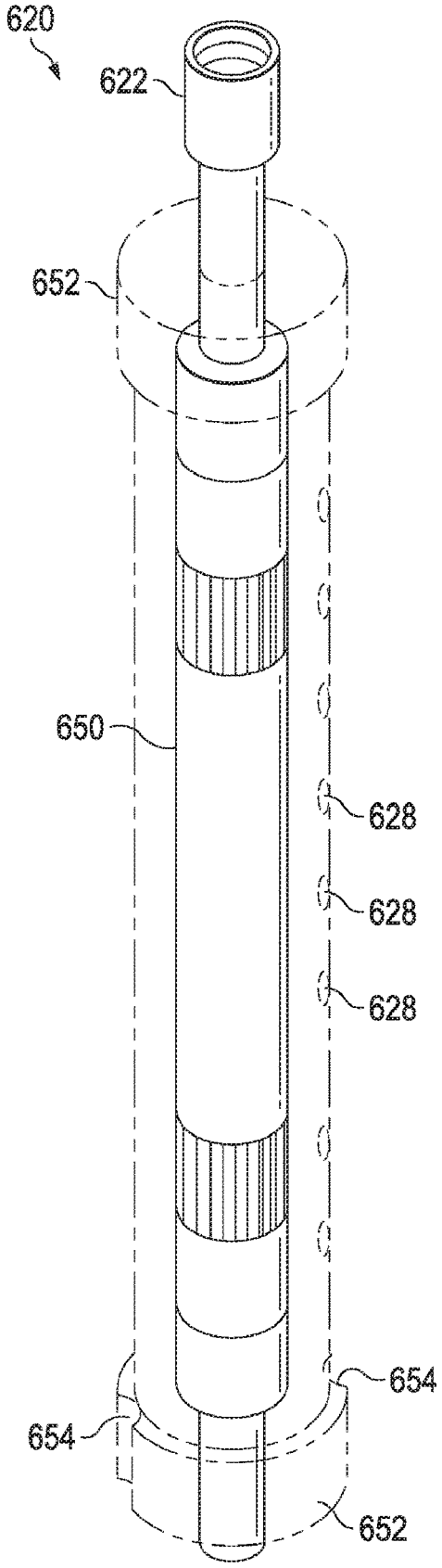
FIG. 6 is a sectioned view of another embodiment of a perforating device according to the present disclosure.

Referring now to FIG. 6, there is shown yet another embodiment of a perforating device 620 according to the present disclosure. Perforating device 620 comprises a central member 622 having a membrane 650 positioned therearound. A group of perforating guns 628 are positioned circumferentially around the central member 622 and membrane 650. The perforating guns 628 may be fastened or bonded with the membrane 650, and in some embodiments, caps 652 may be positioned at both ends of central member 622 to retain the line of perforating guns 628 in place against the membrane 650. In some embodiments, slots 654 in cap 652 may enable radial travel within the cap 652.

The membrane 650 may be a swellable membrane, similar to swell-packers used in well construction, or an inflatable membrane, similar to inflatable membranes used in well construction. A swellable membrane may react with fluid within the wellbore causing the membrane 650 to swell radially outward, articulating the perforating guns 628 radially outward. An inflatable membrane may be activated by internal fluid pressurization within the well, inflating the membrane 650 radially outward thereby pushing the perforating guns 628 radially outward toward the wellbore target. The explosive charges may then be detonated when the perforating guns 628 are proximate with the wellbore target, (such as, e.g. the casing wall) in a second deployed position, thereby perforating the wellbore target. Once the explosive charges have been detonated, the pressure within membrane 650 may be vented or released, balancing the internal and external pressure of the membrane 650, pulling the perforating guns 628 radially inward from the second deployed position back to a first undeployed position.

Figure 7:
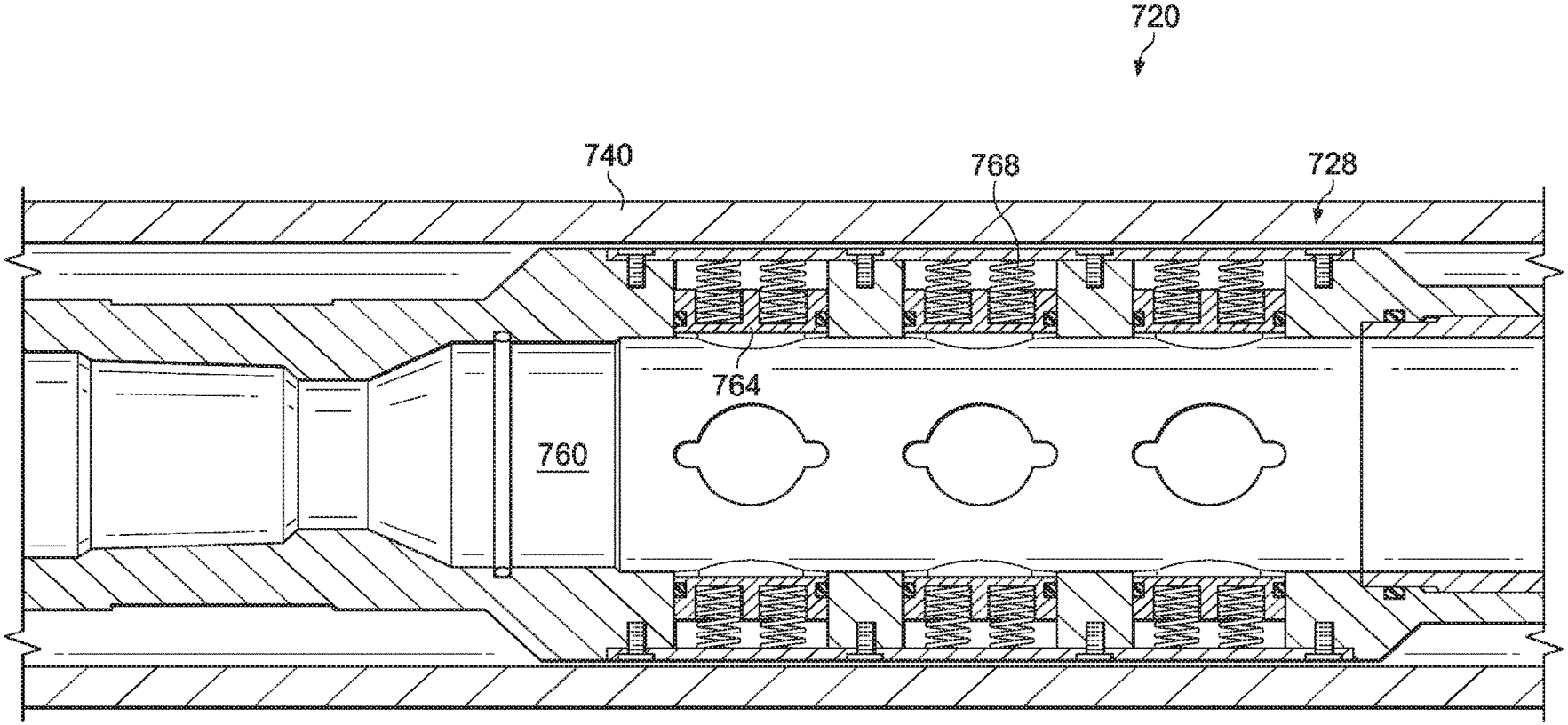
FIG. 7 is a sectioned view of yet another embodiment of a perforating device according to the present disclosure.

Referring now to FIG. 7 there is shown another embodiment of a perforating device 720 according to the present disclosure. Perforating device 720 includes a center member 760, which may be a radial hydraulic cylinder, with radially disposed hydraulic pistons 764 thereabout. A plurality of return springs 768 are coupled with the pistons 764. One or more perforating guns 728 may be positioned at distal ends of the return springs 768. The center member 760 engages the pistons 764 thereby moving the return springs 768 and perforating guns 728 radially outward toward wellbore target 740. Once the perforating guns 728 are radially proximate with the wellbore target 740, the explosive charges on the perforating guns 728 may be detonated and the return springs 768 returned radially inward thereafter. The pistons 764 may be deployed by hydraulic or mechanical forces well known to those skilled in the art, similar to mechanical and hydraulic activation discussed hereinabove in conjunction with FIGS. 2A through 6.

Other embodiments of a perforating device may utilize a stent style deformable central member that uses bi-stable cell geometry. Applying an axial load to the central member deflects the bi-cell geometry, thereby increasing the effective diameter of the central member. Perforating guns being positioned along the central member are correspondingly moved outward proximal to the wellbore target. Once the explosive charges have been detonated, the axial load on the central member may be relaxed, relying on an unstressed shape of the bi-stable cell geometry to pull the perforators back toward the central member's axis to the first undeployed position.

Those skilled in the art to which this application relates will appreciate that other and further additions, deletions, substitutions and modifications may be made to the described embodiments. Each of the foregoing embodiments may comprise one or more of the following additional elements singly or in combination, and neither the example embodiments or the following listed elements limit the disclosure, but are provided as examples of the various embodiments covered by the disclosure.

Embodiments disclosed herein include:

A perforating device for use within a wellbore, comprising: a center member having a length; an expansion tool positioned about the center member along at least a portion of the length; and a plurality of perforating guns positioned about the expansion tool, each of the plurality of perforating guns configured to carry one or more explosive shaped charges. The expansion tool may be configured to move the plurality of perforating guns radially outward toward a wellbore target of the wellbore it is configured to be positioned within.

In another embodiment, there is disclosed a perforating system, for use within a wellbore, comprising: a conveyance mechanism suspended from a service rig; and a perforating device. The perforating device may comprise a center member having a length; an expansion tool positioned about the center member along at least a portion of the length; and a plurality of perforating guns positioned about the expansion tool, each of the plurality of perforating guns configured to carry one or more explosive shaped charges; wherein the expansion tool is configured to move the plurality of perforating guns radially outward toward a wellbore target of the wellbore it is configured to be positioned within.

In yet another embodiment, there is disclosed a method of perforating a wellbore target, the method comprising: connecting a conveyance mechanism with a service rig positioned over a well; connecting at least one perforating device to the conveyance mechanism, the perforating device comprising: a center member having a length; an expansion tool positioned about the center member along at least a portion of the length; and a plurality of perforating guns positioned about the expansion tool, each of the plurality of perforating guns carrying one or more explosive shaped charges; wherein the expansion tool is configured to move the plurality of perforating guns radially outward toward the wellbore target of a wellbore it is configured to be positioned within; conveying the at least one perforating device into the well; moving the plurality of guns radially outward toward the wellbore target; and detonating the explosive shaped charges of the plurality of perforating guns.

Each of the foregoing embodiments may comprise one or more of the following additional elements singly or in combination, and neither the example embodiments or the following listed elements limit the disclosure, but are provided as examples of the various embodiments covered by the disclosure:

Element 1: wherein the plurality of perforating guns are positioned circumferentially about the center member.

Element 2: wherein the plurality of perforating guns are positioned at one or more intervals along the length.

Element 3: wherein the expansion tool includes a finger carrier having a plurality of fingers, each finger comprising first and second bars coupled by a pivot pin, the plurality of fingers having the plurality of perforating guns positioned proximate associated pivot pins, and configured to expand outward to move the plurality of perforating guns radially outward toward the wellbore target.

Element 4: wherein the expansion tool includes a plurality of substantially parallel fingers having the plurality of perforating guns positioned at distal ends thereof, the plurality of substantially parallel fingers configured to expand outward to move the plurality of perforating guns radially outward toward the wellbore target.

Element 5: wherein the expansion tool includes a sliding mandrel having a plurality of fingers, the plurality of fingers having the plurality of perforating guns positioned proximate endpoints thereof, the plurality of fingers configured to expand outward to move the plurality of perforating guns radially outward toward the wellbore target based upon movement of the sliding mandrel.

Element 6: wherein the plurality of perforating guns are mounted atop a series of leaf springs located circumferentially about the center member, wherein the expansion tool includes a profiled mandrel configured to travel axially within the center member, and engage the series of leaf springs, moving the leaf springs outward to move the plurality of perforating guns radially outward toward the wellbore target.

Element 7: wherein the expansion tool further includes a swellable membrane which upon fluid submersion moves the plurality of perforating guns radially outward toward the wellbore target.

Element 8: wherein the expansion tool includes a central member with radially disposed hydraulic pistons.

Element 9: wherein the plurality of perforating guns are positioned circumferentially about the center member at one or more intervals along the length.

Element 10: wherein the expansion tool includes a profiled mandrel having a plurality of fingers, each finger comprising first and second bars coupled by a pivot pin, the plurality of fingers having the plurality of perforating guns positioned proximate associated pivot pins, and configured to expand outward to move the plurality of perforating guns radially outward toward the wellbore target.

The foregoing listed embodiments and elements do not limit the disclosure to just those listed above.

Those skilled in the art to which this application relates will appreciate that other and further additions, deletions, substitutions and modifications may be made to the described embodiments.

What is claimed is:

1. A perforating device for use within a wellbore, comprising:

a center member having a length;

an expansion tool positioned about the center member along at least a portion of the length; and a plurality of perforating guns positioned about the expansion tool, each of the plurality of perforating guns configured to carry one or more explosive shaped charges;

wherein the expansion tool is configured to move the plurality of perforating guns radially outward toward a wellbore target of the wellbore it is configured to be positioned within; and wherein the expansion tool includes a plurality of substantially parallel fingers having the plurality of perforating guns positioned at distal ends thereof, the plurality of substantially parallel fingers configured to expand outward to move the plurality of perforating guns radially outward toward the wellbore target.

2. The perforating device as recited in claim 1, wherein the plurality of perforating guns are positioned circumferentially about the center member.

3. The perforating device as recited in claim 1, wherein the plurality of perforating guns are positioned at one or more intervals along the length.

4. A perforating system, for use within a wellbore, comprising:

a conveyance mechanism suspended from a service rig; and a perforating device, the perforating device comprising:

a center member having a length;

an expansion tool positioned about the center member along at least a portion of the length; and a plurality of perforating guns positioned about the expansion tool, each of the plurality of perforating guns configured to carry one or more explosive shaped charges;

wherein the expansion tool is configured to move the plurality of perforating guns radially outward toward a wellbore target of the wellbore it is configured to be positioned within; and wherein the expansion tool includes a plurality of substantially parallel fingers having the plurality of perforating guns positioned at distal ends thereof, the plurality of substantially parallel fingers configured to expand outward to move the plurality of perforating guns radially outward toward the wellbore target.

5. The perforating system as recited in claim 4, wherein the plurality of perforating guns are positioned circumferentially about the center member.

6. The perforating system as recited in claim 4, wherein the plurality of perforating guns are positioned at one or more intervals along the length.

7. A method of perforating a wellbore target, the method comprising:

connecting a conveyance mechanism with a service rig positioned over a well;

connecting at least one perforating device to the conveyance mechanism, the perforating device comprising:

a center member having a length;

an expansion tool positioned about the center member along at least a portion of the length; and a plurality of perforating guns positioned about the expansion tool, each of the plurality of perforating guns carrying one or more explosive shaped charges;

wherein the expansion tool is configured to move the plurality of perforating guns radially outward toward the wellbore target of a wellbore it is configured to be positioned within; and wherein the expansion tool includes a plurality of substantially parallel fingers having the plurality of perforating guns positioned at distal ends thereof, the plurality of substantially parallel fingers configured to expand outward to move the plurality of perforating guns radially outward toward the wellbore target conveying the at least one perforating device into the well;

moving the plurality of guns radially outward toward the wellbore target; and detonating the explosive shaped charges of the plurality of perforating guns.

8. The method of perforating a wellbore target as recited in claim 7, wherein the plurality of perforating guns are positioned circumferentially about the center member at one or more intervals along the length.

* * * * *